US006554236B2

(12) United States Patent
Marsh

(10) Patent No.: US 6,554,236 B2
(45) Date of Patent: Apr. 29, 2003

(54) REINFORCED LOCKING SHELF SUPPORT

(75) Inventor: Thomas R. Marsh, High Point, NC (US)

(73) Assignee: Tenn-Tex Plastics, Inc., Colfax, NC (US)

( * ) Notice: Subject to any disclaimer, the term of this patent is extended or adjusted under 35 U.S.C. 154(b) by 0 days.

(21) Appl. No.: 09/854,791

(22) Filed: May 14, 2001

(65) Prior Publication Data

US 2002/0166934 A1 Nov. 14, 2002

(51) Int. Cl.[7] ..... A47G 29/02; E04G 3/08

(52) U.S. Cl. ..... 248/235; 248/239; 248/248; 248/250

(58) Field of Search ..... 248/248, 235, 248/239, 250, 243

(56) References Cited

U.S. PATENT DOCUMENTS

| | | | | |
|---|---|---|---|---|
| 1,829,009 A | | 10/1931 | Madsen | 248/243 |
| 3,471,112 A | | 10/1969 | MacDonald et al. | 248/239 |
| 4,037,813 A | | 7/1977 | Loui et al. | 248/250 |
| 4,053,132 A | | 10/1977 | Del Pozzo | 248/235 |
| 4,432,523 A | | 2/1984 | Follows | 248/250 |
| 4,666,117 A | | 5/1987 | Taft | 248/243 |
| 4,732,358 A | | 3/1988 | Hughes et al. | 248/243 |
| 4,819,901 A | | 4/1989 | McDonald | 248/250 |
| 4,856,746 A | | 8/1989 | Wrobel et al. | 248/250 |
| 5,080,311 A | | 1/1992 | Engstrom | 248/250 |
| 5,195,708 A | | 3/1993 | Marsh | 248/250 |
| 5,326,061 A | * | 7/1994 | Hamilton | 248/239 |
| 6,186,456 B1 | | 2/2001 | Marsh | 248/243 |

OTHER PUBLICATIONS

Photographs of prior art shelf support.
Photographs of second prior art shelf support.

* cited by examiner

*Primary Examiner*—Anita King
*Assistant Examiner*—Amy J. Sterling
(74) *Attorney, Agent, or Firm*—Myers Bigel Sibley & Sajovec

(57) ABSTRACT

Shelf supports are provided that comprise a body member, a finger, a shelf flange, a stem holder and a metal stem. The body member may include a lower body portion and an upper body portion, where the upper body portion may have an inner opening formed therein. The shelf flange may extend from a front face of the lower body portion, and the finger may extend downwardly from adjacent the top of the opening towards the shelf flange. Typically, the finger is dimensioned to be collapsibly received within the inner opening. The stem holder may include a cavity for receiving at least part of the stem, and at least part of the stem extends from a back face of the body member so that it may be received within an aperture on the wall to which the shelf support is to be mounted.

22 Claims, 3 Drawing Sheets

REINFORCED LOCKING SHELF SUPPORT

FIELD OF THE INVENTION

The present invention relates to shelf supports that may be used to support shelves between oppositely facing upright members such as cabinet side walls, and, more particularly, to reinforced locking shelf supports having increased load-bearing capacity.

BACKGROUND OF THE INVENTION

Brackets that support shelves inside cabinets, bookcases, and the like, and permit the shelves to be readily adjustable have been known for some time. However, the shipping of cabinets with internal shelves presents a problem. With shelf supports that do not also positively retain or lock the shelf in place, the jostling or shock that the article of furniture receives during shipping and handling can cause the shelf to bounce around within the cabinet and damage the cabinet. Even when cabinets are not shipped with shelves installed in place, it may be desirable to lock the shelves in place within the cabinets to prevent jostling and dislodging of the shelves and damage to the contents of any shelf positioned beneath the shelf that is so dislodged. Additionally, the forces exerted on the shelf supports during movement of the cabinet may exceed the forces experienced during normal usage, particularly in instances when the shelf is not positively retained in its proper position.

Various shelf supports having a retaining mechanism to maintain the shelf in position have been proposed. Examples are shown in U.S. Pat. Nos. 4,666,117 to Taft; 4,432,523 to Follows; 4,053,132 to Del Pozzo; 3,471,112 to MacDonald et al., and 4,037,813 to Loui et al. However, these shelf supports generally have drawbacks in their ability to securely lock the shelf in place, accommodate usual variability in shelf length, and/or provide sufficient durability. Accordingly, there is a need in the art for improved locking shelf supports.

SUMMARY OF THE INVENTION

Shelf supports are provided that may be used to support shelves between oppositely facing upright members such as cabinet side walls. In embodiments of the present invention, the shelf supports comprise a body member, a finger, a shelf flange, a stem holder and a stem. The body member may include a lower body portion and an upper body portion, where the upper body portion may have an inner opening formed therein. The shelf flange may extend from a front face of the lower body portion, and the finger may extend downwardly from adjacent the top of the opening in the upper body portion towards the shelf flange. Typically, the finger is dimensioned to be collapsibly received within the inner opening. The stem holder includes a cavity for receiving at least part of the stem, and at least part of the stem extends from a back face of the body member so that it may be received within an aperture on the wall to which the shelf support is to be mounted. In use, the back face of the body member may be placed adjacent one of a pair of opposing walls that are to support the shelf. The stem may be formed of metal or some other material capable of withstanding large forces, and may be configured to be received with an aperture in the wall to hold the shelf support in place on the wall. The shelf flange is configured to receive and support an edge of the shelf that is to be disposed between the opposing side walls. The finger may be used to exert a downward force on the top surface of the shelf to lock the shelf in place.

In other embodiments of the present invention, the body member may include an aperture adjacent the stem holder, so that a portion of the stem may pass through the aperture into the cavity in the stem holder. In these embodiments, the stem holder may extend from the front face of the lower body portion of the body member, and the top of the stem holder may engage the a lower surface of the shelf flange so as to reinforce the shelf flange. The shelf support may be formed by injection molding a polymer material so as to partly or fully encase the metal stem, and the portion of the stem so encased may include a head having a cross section larger than the cross section of the remainder of the stem so as to firmly lock the stem within the stem holder. The shelf support may also include one or more reinforcing gussets connected between the lower body portion and the underside of the stem holder.

Methods of making shelf supports according to the present invention via injection molding techniques are also provided.

BRIEF DESCRIPTION OF THE DRAWINGS

The accompanying drawings, which are incorporated in and constitute a part of the specification, illustrate embodiments of the invention and, together with the description, serve to explain principles of the invention.

DETAILED DESCRIPTION OF PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout. The dimensions of some components may be exaggerated for clarity.

The shelf supports described herein may be employed in any type of furniture, including but not limited to book cases, cabinets (including china cabinets, curio cabinets, hutches, display cabinets, etc.) and the like. The furniture may be free-standing furniture, as well as installed, custom-made, or wall-mounted furniture such as kitchen cabinets, custom closet assemblies and wall units.

Figure 1:
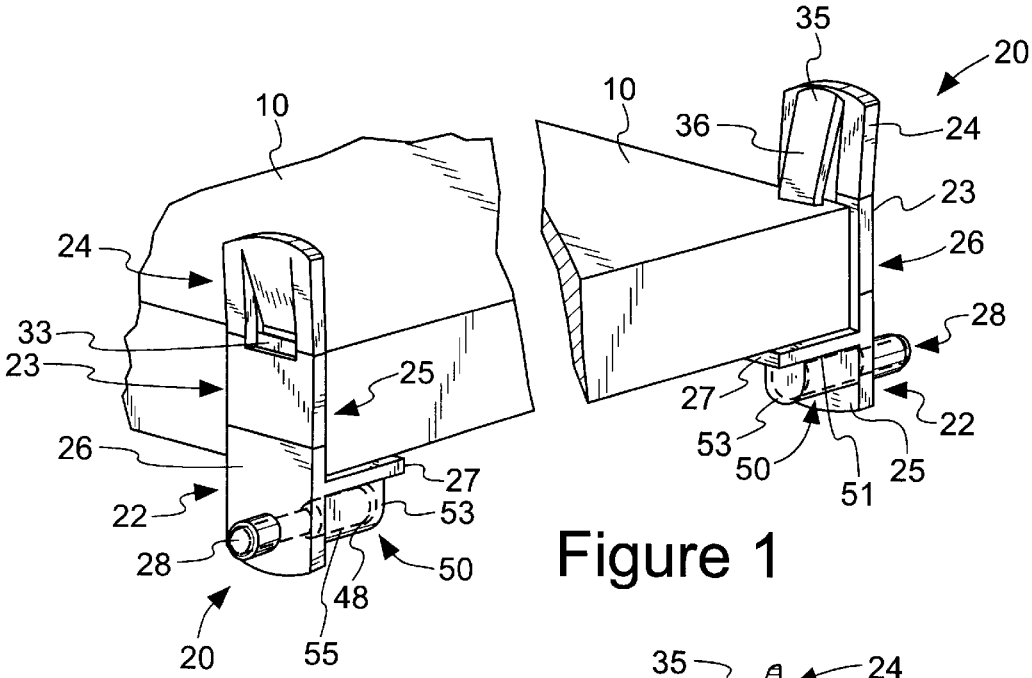
FIG. 1 is a perspective view of a cabinet or like structure that incorporates a pair of shelf supports, each shelf support constructed in accordance with the present invention.
Figure 2:
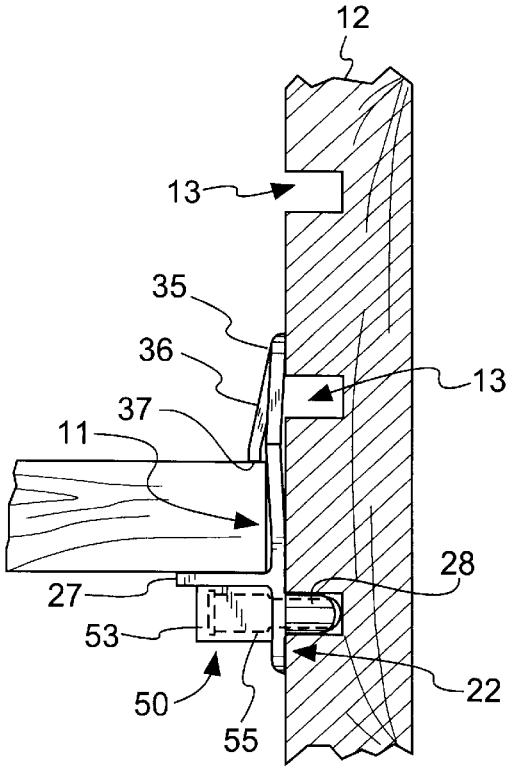
FIG. 2 is a side sectional view of an individual shelf support of the present invention installed in a cabinet wall as in FIG. 1.

FIG. 1 shows a pair of shelf supports 20 of the present invention supporting a shelf 10. As shown in FIG. 2, each shelf support 20 is positioned to support the edge portion 11 of the shelf 10 on one wall member 12 of a pair of opposing wall members 12 in a cabinet or the like, as described above. The wall member 12 has at least one, and preferably a series, of holes or openings 13 formed therein to receive and hold the shelf support 20, as described below. In a typical embodiment, four shelf supports 20 would be used to support a shelf 10, with two such shelf supports 20 supporting opposite ends of each shelf edge portion 11.

As shown in FIGS. 1–4, the shelf support 20 comprises a body member 21 that has a lower body portion 22, a middle body portion 23, and an upper body portion 24. The body member 21 and its constituent lower, middle and upper body portions 22, 23, 24 have a front face 25 and a back face 26. At least part of the back face 26 may be substantially planar so as to facilitate placing the shelf support 20 to lie against the opposing upright wall member 12 in which it is installed. A shelf flange 27 is connected to the lower body portion 22 front face 25, and a stem 28 extends from the back face 26 of the lower body portion 22.

The shelf support 20 further includes a stem holder 50 that is configured to receive at least a portion of the stem 28. In the embodiment of FIGS. 1–4, the stem holder 50 extends from the front face 25 of the lower body portion 22 immediately below the shelf flange 27. The stem holder 50 in the pictured embodiment is generally cylindrical in shape, but includes a flat upper surface 51 that connects to the lower surface of the shelf flange 27. A fixed end 52 of the stem holder 50 abuts the front face 25 of the lower body portion 22, and a free end 53 is disposed underneath the shelf flange 27.

The stem holder 50 includes an opening 54 in its fixed end 52 that leads to a central cavity 55. The central cavity 55 is configured to receive at least part of the stem 28. In the embodiment of FIGS. 1–4, the lower body portion 22 includes an aperture 29 that is located adjacent the connection between the stem holder 50 and the lower body portion 22. A portion of the stem 28 is received by both the aperture 29 and the cavity 55 in the stem holder 50. The remainder of the stem 28 extends from the aperture 29 in the lower body portion 22 so as to extend beyond the back face 26 of the body member 21. This portion of the stem 28 may be received within an aperture 13 on a side wall 12 of a cabinet or other piece of furniture to mount the shelf support 20 on the side wall 12 as shown in FIG. 2.

Figure 5:
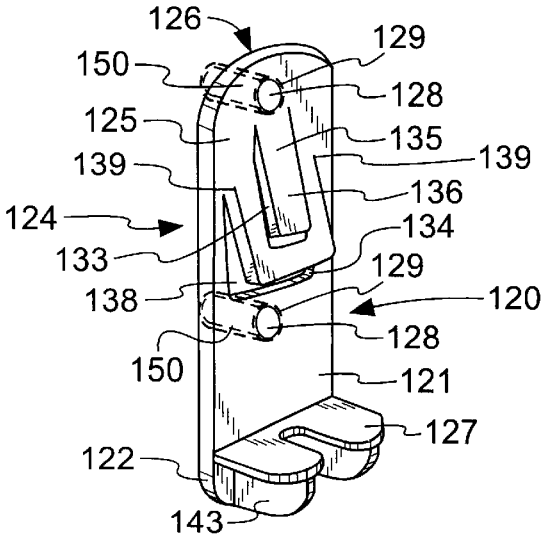
FIG. 5 is a perspective view of a shelf support according to an alternative embodiment of the present invention prior to being installed in a cabinet.
Figure 6:
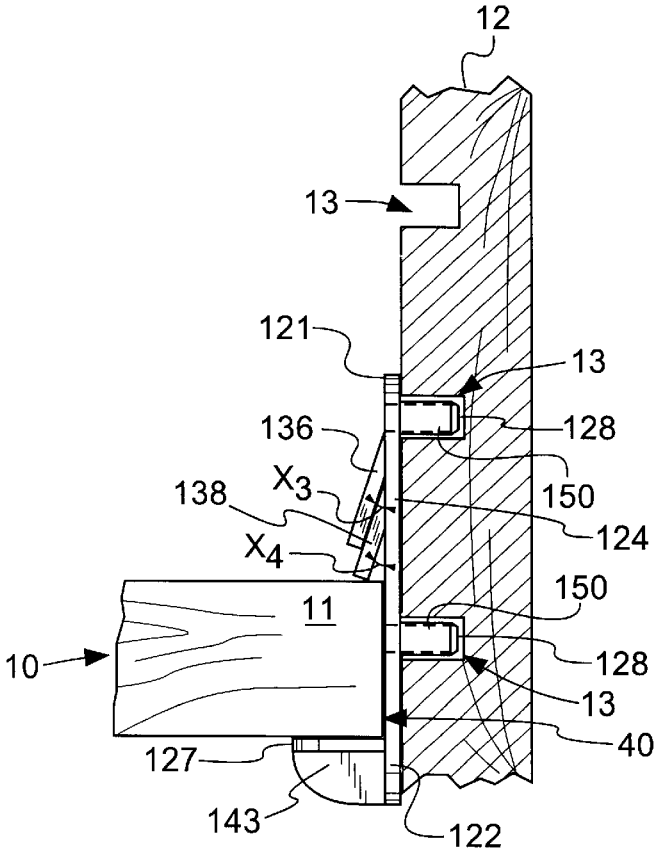
FIG. 6 is a side sectional view of the shelf support of FIG. 5 installed in a cabinet side wall.

It will be appreciated that the stem holder 50 may be mounted on either, or both, the front face 25 and/or the back face 26 of the body member 21. An exemplary embodiment of the present invention in which the stem holder 50 is mounted on the back face 26 of body member 21 is depicted in FIGS. 5 and 6, which are discussed in more detail herein. It will also be appreciated that the stem holder 50 may be implemented in a variety of different shapes, and need not necessarily be implemented in the substantially cylindrical shape depicted in FIGS. 1–4.

In the embodiment of FIGS. 1–4, the stem holder 50 is located directly below the shelf flange 27. In this manner, the stem holder 50 may provide structural support to the underside of shelf flange 27, thereby allowing shelf flange 27 to support increased weight. Additionally, as discussed in more detail below, the stem 28 is formed of metal. The provision of a metal stem underneath the shelf flange 27 (within the stem holder 50) may further increase the structural support provided to the underside of the shelf flange 27. However, as will be clear from the description of the various alternative embodiments of the present invention depicted and/or described herein, the stem holder 50 need not be provided directly underneath the shelf flange 27 and, in fact, need not even be provided on the front face 25 of body member 21.

Figure 3:
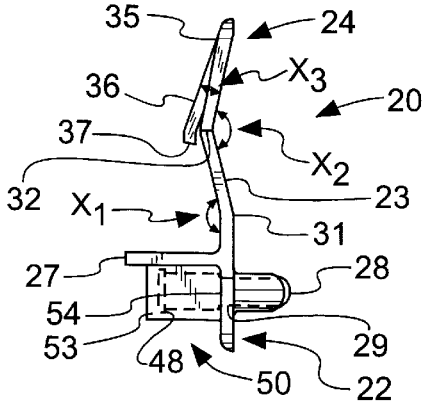
FIG. 3 is a side view of a shelf support of the present invention prior to being installed in a cabinet.

As shown best in FIG. 3, one end of the stem 28 may include a head 48 having a larger cross section than the remainder of the stem 28. In this embodiment, the cavity 55 in the stem holder 50 may include a region having a larger cross-section so as to receive this head 48 of the stem 28. Such an embodiment of the present invention could be formed, for example, by placing the head end of a rivet in a mold having the shape of the non-stem components of the shelf support 20, where part of the distal end of the rivet protrudes from the mold. A polymer material such as ABS may then be injected into the mold to form the shelf support 20, with the rivet serving as the stem 28. The stem holder 50 is formed in this injection molding process around the stem 28 (i.e., the rivet). This injection molding process can serve to lock the stem 28 in place within the stem holder 50 without further secondary operations. Additionally, since the head 48 of the stem 28 has a larger cross section than most of the cavity 55 in the stem holder 50 in which it is received, the head 48 serves to further retain the stem holder 50 in place within the stem holder 50.

It will also be appreciated that various other stem configurations could be used, including configurations having both uniform and non-uniform cross sections across the length of the stem 28. Uniform cross sections may be preferable (but not required) in embodiments in which the stem 28 is inserted into the stem holder 50 after manufacture of the non-stem components of the shelf support 20. Various non-uniform cross section configurations of stem 28 may be preferable (but not required) in embodiments in which the stem 28 is molded into the stem holder 50 during manufacture of the shelf support 20. It will be appreciated that a wide variety of different non-uniform cross-sectional configuration could be used, such as, for example, providing a head 48 on the stem 28 as shown in FIG. 3, knurling or undercutting the stem 28, or otherwise varying the shape of the stem 28 along its cross-section so that during molding the stem 28 is locked into the stem holder 50.

By mounting the stem 28 in a stem holder 50 located on the front face 25 of the body member 21, the structural integrity of the stem 28 may be significantly increased. In particular, the forces imparted by the shelf 10 and the sides of the apertures 13 on the stem 28 may be distributed over the length of the stem 28 instead of being concentrated at the interface between the stem 28 and the back face 26 of the body member 21. In other shelf supports, the weight that the shelf support can support may be limited by the amount of force the interface between the stem and the body of the shelf support may withstand without weakening and/or breaking the stem away from the body. Thus, by providing a stem that is more resistant to breakage (i.e., by having the stem extend through the body member 21 into a stem holder 50 and by forming the stem out of metal), the load carrying capability of the shelf support 20 may be increased.

Referring to FIG. 3, it can be seen that the middle body portion 23 is connected to the lower body portion 22 at a first resilient junction 31, with the middle body portion 23 and the lower body portion 22 forming an obtuse angle $x_1$ on the front face of the body member 21. The upper body portion 24 is connected to the middle body portion 23 at a second resilient junction 32, with the upper body portion 24 having an inner opening 33 formed therein. The inner opening 33 may be generally rectangular in shape, and may extend downward toward the middle body portion 23. Adjacent the top of the inner opening 33, a finger 36 is connected at a third resilient junction 35, where the finger 36 extends downward toward the middle body portion 23. In the embodiment of FIGS. 1–4, the finger 36 is rectangular in shape and substantially flat, although other configurations are possible. The finger 36 may be dimensioned to be collapsibly received within the inner opening 33.

As best seen in FIGS. 2 and 3, the finger 36 projects away from the side wall 12 to which the shelf support 20 is mounted. The finger 36 includes a lower shelf retaining edge 37. The portion of the finger 36 including the shelf retaining edge 37 may be angled with respect to the remainder of the finger 36, so that the shelf retaining edge 37 may rest flat upon the top surface of the shelf 10 as shown in FIG. 2. Alternatively, this angle may be omitted, and/or the shelf retaining edge 37 may be formed at an angle with respect to the body of the finger 36 to allow the shelf retaining edge 37 to lie flat against the shelf 10 when the shelf 10 is in place. Configuring the shelf retaining edge 37 to lie flat against the shelf 10 may improve the ability of the finger 36 to inhibit movement of the shelf 10 in the vertical direction, and may also help avoid the finger 36 marring or scratching the top surface of the shelf 10.

The middle body portion 23 and the upper body portion 24 together form an obtuse angle $x_2$ at the second resilient junction 32. The angle $x_2$ tends to increase as a shelf edge portion 11 is moved over the upper body portion 24 towards the shelf flange 27. In contrast, the finger 36 and the upper body portion 24 together form an acute angle $x_3$ at the third resilient junction 35. The angle $x_3$ tends to decrease as the shelf edge portion 11 is moved past the upper body portion 24 towards the shelf flange 27. When a shelf edge portion 11 is moved over the upper body portion 24 so as to contact the shelf flange 27, the finger 36 returns to its aforesaid "normal" position projecting away from the back face 26 of the upper body portion 24, the shelf retaining edge 37 engages the shelf end portion 11, and the shelf 10 is locked in place between the shelf retaining edge 37 and the shelf flange 27 (with the shelf retaining edge 37 abutting the top of the shelf 10 and the shelf flange 27 abutting the bottom of the shelf 10). As shown in FIG. 2, the middle body portion 23, which has been compressed against the side wall 12 as the shelf edge portion 11 is forced towards the shelf flange 27, can then exert a compressive force against the side face 40 of the shelf edge portion 11 and help reduce lateral movement of the shelf 10. However, since this compressing force is exerted primarily by action of the first and second resilient junctions 31, 32, the finger 36 is substantially free to snap back or recover to its normal position due to the now unrestricted travel at resilient junction 35. Thus, the middle body portion 23 can act to inhibit lateral movement of the shelf 10 without detracting from the ability of the finger 36 to inhibit vertical movement of the shelf 10.

Figure 4:
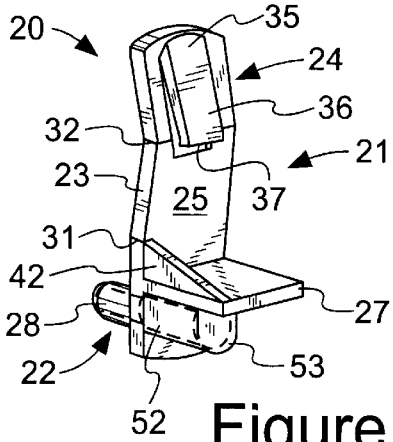
FIG. 4 is a perspective view of a shelf support of the present invention prior to being installed in a cabinet.

As best seen in FIG. 4, the inner opening 33 may extend beyond the second resilient junction 32 into the middle body portion 23, and the finger 36 may also extend downward beyond the second resilient junction 32, which may serve to increase the distance between the shelf retaining edge 37 and the body member 21. Because the middle body portion 23 is now angling away from the direction of the upper body portion 24 in the opposite direction from which the finger 36 is angling away from the upper body portion 24, this allows the shelf retaining edge 37 to contact the shelf edge portion 11 at a greater distance from the side face 40 and helps to reduce inadvertent slippage of the shelf 10 past the shelf retaining edge 37 (particularly when the shelf 10 is of less than average width).

The shelf flange 27 may be connected to the lower body portion 22 at a position below the first resilient junction 31. This permits inclusion of a side abutment portion 42 connected to the shelf flange 27 and the lower body portion 22 (only the shelf support 20 of FIG. 4 is depicted as including a side abutment 42). The side abutment portion 42 serves to prevent forward motion of the shelf 10. Locating the first resilient junction 32 above the flange 27 may also advantageously increase the resilience of the junction 32 (as the connection between the shelf flange 27 and the lower body portion may impede resilience), and may also serve to increase the strength of the junction.

Additionally, the shelf support 20 may optionally include one or more reinforcing gussets 43 (not shown in FIGS. 1–4) that connect to the stem holder 50 and the lower body portion 22 to strengthen the stem holder 50 (and thereby the shelf flange 27) and thus increase the load that can be carried by the shelf flange 27. These reinforcing gussets 43 may also be connected directly between the shelf flange 27 and the lower body portion 22 (See FIGS. 5 and 6).

FIG. 5 is a perspective view and FIG. 6 is a side view of a shelf support 120 according to alternative embodiments of the present invention. As shown in FIG. 5, the shelf support 120 comprises a body member 121 that has a lower body portion 122 and an upper body portion 124. The body member 121 has a front face 125 and a back face 126. A shelf flange 127 is connected to the lower body portion 122, and a pair of stems 128 extend from the back face 126 of the body member 121.

In the embodiment of FIGS. 5 and 6, the shelf support 120 includes a pair of stem holders 150 that are configured to circumferentially surround the respective stems 128. These stem holders 150 extend from the back face 126 of the body member 121. Typically, the stem holders 150 will be circular in shape (as the apertures 13 in the side walls 12 are typically circular), and each of the cylindrical stem holders 150 includes a cavity in the inside of the cylinder that receives the respective stem 128. In embodiments of the present invention, the stem holders 150 are formed of a polymer material, while the stems 128 are formed of metal. In these embodiments, the stem holders 150 may serve to both connect the stems 128 to the shelf support 120, and also may serve to protect the side walls 12 of the furniture in which the shelf supports 120 are used from the harder, less pliant, metal stems 128 that may more likely to damage the side walls 12. The stem 128 may also have various uniform or cross-sections over its length as discussed above with respect to the shelf support 20.

The body member 121 may include apertures 129 adjacent the connection between each stem holder 150 and the body member 121. In embodiments of the shelf support 120 that include such apertures, a portion of the stems 128 may be received within respective of these apertures 129. By allowing the stems 128 to extend beyond the ends of their respective stem holders 150 and into their respective apertures 129, the tendency of the stems 128 and/or stem holders 150 to sheer off when a shelf 10 is placed on the shelf flange 127 may be reduced. This may be particularly true when the stems 128 are formed of metal.

In embodiments of the shelf support 120, the end of one or more of the stems 128 may include a head 148 having a larger cross section than the remainder of the stem 128 (not pictured in FIGS. 5 and 6). The end of the stem 128 including the head 148 may be molded into the body member 121. In this manner, the body member may provide increased support to the stem 128, thereby decreasing the possibility that the stem holder and stem sheer off if excessive force is applied to the shelf flange 127 when the stems 128 and stem holders 150 are inserted in the apertures 13 in the side wall 12. The stem 128 may also have various uniform or non-uniform cross-sections over its length as discussed above with respect to shelf support 20.

As noted above, in the embodiment of FIGS. 5 and 6, the stems 128 are formed of metal. The use of these metal stems may significantly increase the weight that the shelf support can support. By forming the stems 128 out of metal it may be possible to increase their resistance to breakage. This may allow for the use of smaller, less visible shelf supports which may be more aesthetic.

As shown best in FIG. 5, the body member 121 has an upper body portion 124 that includes an inner opening 133. The inner opening 133 may be rectangular or some other shape, and extends downward toward a lower body portion 122 of the body member 121. Adjacent the top of the inner opening 133 a first finger 136 is connected to the upper body portion 124 at a resilient junction 135, where the first finger 136 extends downward toward the lower body portion 122. The first finger 136 may be rectangular in shape and substantially flat, although other configurations are possible. The first finger 136 may be dimensioned to be collapsibly received within the inner opening 133.

The upper body portion 124 may further include a second inner opening 134. As seen best in FIG. 5, this second inner opening 134 may surround the first inner opening 133. Adjacent the top outside edges of the second inner opening 134 a second U-shaped finger 138 may be connected to the upper body portion 124. The second U-shaped finger 138 may be configured so as to define the lower portion of opening 133 and so that the first finger 136 may be collapsibly received within the interior of the second U-shaped finger 138. The second U-shaped finger 138 connects to the upper body portion at a second pair of resilient junctions 139, and the second U-shaped finger 138 may be dimensioned so that it may be collapsibly received within the second inner opening 134. The U-shaped finger 138 may also have various other shapes (e.g., V-shaped), as may the second inner opening 134.

When a shelf 10 is lowered across the upper body portion 124 to rest on the shelf flange 127, the side edge 40 of the shelf may contact the first and second fingers 136, 138. When this occurs, the first finger 136 may move about the first resilient junction 135 so as to collapse into the first inner opening 133, and the second U-shaped finger 138 may move about the second resilient junctions 139 so as to collapse into the second inner opening 134. If the shelf is thinner than the distance between the shelf flange 127 and the distal edge 137 of second finger 138, then both first and second fingers 136, 138 will return to their aforesaid "normal" position once the shelf 10 falls out of contact with them. This permits the distal edge 137 of second finger 138 to abut the top surface of shelf 10, thereby locking the shelf into place.

If instead the shelf is thicker than the distance between the shelf flange 127 and the distal edge 137 of second finger 138, then the side 40 of shelf 10 never loses contact with the second finger 138, even when the shelf comes to rest on shelf flange 127. In this situation, the force applied by the side 40 of shelf 10 keeps the second finger 138 collapsed into the second opening 134. However, if the shelf 10 is sufficiently thin, it will come out of contact with the first finger 136, thereby allowing the first finger to return to its aforementioned "normal" position above the top surface of shelf 10, thus serving to lock shelf 10 in place. Thus, by the inclusion of two separate fingers 136, 138, the shelf support 120 may serve to lock shelves 10 of varying width into place.

As best seen in FIG. 6, the first and second fingers 136, 138 project away from the side wall 13 to which the shelf support 120 is mounted. Moreover, the fingers 136, 138 meet the upper body portion 124 at acute angles $x_3$, $x_4$. As discussed above, these angles $x_3$, $x_4$ tend to decrease as a shelf edge portion 11 contacts the respective fingers 136, 138 as it is moved over the upper body portion 124 towards the shelf flange 127. However, when the shelf edge portion 11 is moved over the upper body portion 124 and contacts the shelf flange 127, one or both of the fingers 136, 138 will return to the aforesaid "normal" position in which they project away from the side wall 12 as soon as the side 40 of the shelf edge portion 11 stops contacting the finger(s) 136, 138.

In this embodiment of the present invention, a distinct boundary may or may not be provided between the lower body portion 122 and the upper body portion 124. Additionally, the shelf support 120 may optionally include one or more reinforcing gussets 143 connected to the shelf flange 127 and the lower body portion 122 to strengthen the shelf flange 127 and increase the load that can be carried by the flange 127.

Aside from the metal stem, the shelf supports described herein may be conveniently formed as a single unitary piece or part of a suitable resilient synthetic organic polymer material such as acrylonitrile butadiene styrene (ABS) or polycarbonate. The part may be formed by any suitable process, typically by molding and preferably by injection molding. As discussed below, the stem may be placed in the mold during the injection molding operation to lock the stem in place and form a one-piece shelf support.

In the pictured embodiments, various of the parts of the shelf support are shown with specific shapes such as the body members 21, 121, which are substantially rectangular in shape, the middle and upper body portions 23, 123, 24, 124, which are rectangular and substantially flat, the stems 28, 128, which are generally cylindrical in shape, and other elements. Those of skill in the art will appreciate that the depicted shapes are not intended to be limiting, and that various other shapes and configurations may be used for various of the components of the shelf supports disclosed herein.

In typical applications, four shelf supports would be used to support a shelf 10, with two such shelf supports supporting opposite ends of each shelf edge portion 11. The shelf supports may be mounted exclusively on the side walls 12 of the cabinet or other piece of furniture, or may also be mounted on a back wall (not shown in the figures). While shelf supports of the present invention are intended to be used in pairs, and particularly two pairs for each shelf, it will be appreciated that a shelf support of the invention could be used on one side of a shelf and a different type of support could be used on the other side, particularly where sufficient locking is obtained with a single locking-type shelf support. It will also be appreciated the some, all, or none of the supports may include a side abutment portion, depending upon whether the cabinet has a solid back, front edge portions, or the like.

Figure 7:
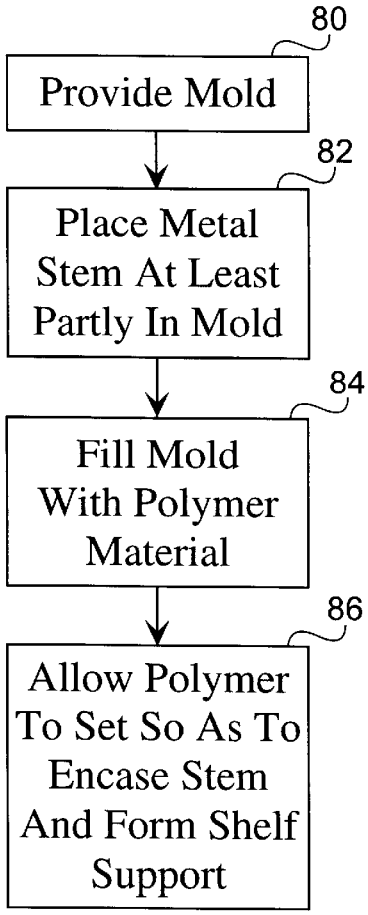
FIG. 7 is a flow chart detailing a method of making shelf supports according to the present invention.

FIG. 7 is a flowchart diagram that describes aspects of methods of making shelf supports according to the teachings of the present invention. As shown in FIG. 7, pursuant to these methods a mold may be provided that has an inner cavity that defines the shape of the shelf support (block 80). A metal stem that is to be used with the shelf support and molded into the shelf support may then be placed at least partway into the mold (block 82). The mold may then be filled with a polymer material via an injection molding or other process such that the polymer material surrounds at least a portion of the metal stem (block 84). The polymer material may then be allowed to cool so as to fixedly encase at least a portion of the metal stem and to form the remainder of the shelf support (block 86).

Figure 8:
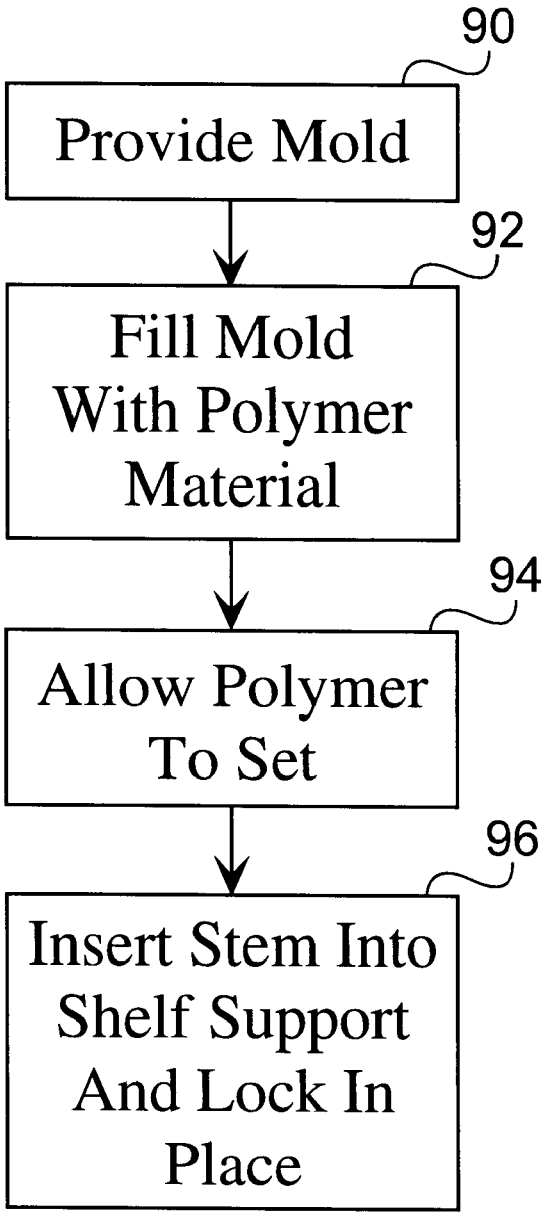
FIG. 8 is a flow chart detailing another method of making shelf supports according to the present invention.

FIG. 8 is a flowchart diagram that describes aspects of an alternative method of making shelf supports according to the present invention. As shown in FIG. 8, pursuant to these methods, a mold may be provided that has an inner cavity that defines the shapes of the non-stem portions of the shelf support (block 90). The mold is then filled with a polymer material, typically via an injection molding process, to form the non-stem portions of the shelf support (block 92). The polymer material may then be allowed to set (block 94). After setting, the stem is inserted into the inner cavity in the stem holder and locked into place via a secondary process such as heat staking or ultrasonic welding (block 96).

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed:

1. A shelf support, comprising:

a body member having a front face and a back face, wherein the body member includes a lower body portion and an upper body portion, and wherein the upper body portion includes an inner opening formed therein;

a shelf flange extending from the front face of the lower body portion of the body member;

a finger extending downwardly from adjacent the top of the opening towards the shelf flange, wherein the finger is dimensioned to be collapsibly received within the inner opening;

a stem holder having a cavity formed therein extending from at least one of the front face or the back face of the body member; and a metal stem that is received at least partly within the cavity in the stem holder, wherein at least a portion of the stem extends from the back face of the body member;

wherein the stem holder extends from the back face of the body member, and wherein the stem holder encases substantially the entire stem.

2. The shelf support of claim 1, wherein the stem has a non-uniform cross section.

3. The shelf support of claim 1, wherein the body member includes an aperture adjacent the stem holder, and wherein a portion of the stem passes through the aperture into the cavity in the stem holder.

4. The shelf support of claim 1, wherein the stem holder extends from the front face of the lower body portion of the body member, and wherein a top surface of the stem holder engages a lower surface of the shelf flange such that the stem holder acts to reinforce the shelf flange.

5. The shelf support of claim 1, wherein the body member, the shelf flange and the stem holder are formed from a polymer material.

6. The shelf support of claim 5, wherein the shelf support is formed using an injection molding process, wherein the cavity in the stem holder is created by injection molding the stem holder so as to at least partly encase the metal stem.

7. The shelf support of claim 1, wherein an upper part of the lower body portion and a lower part of the upper body portion are connected so as to together form an obtuse angle on the front face of the body member, and wherein the obtuse angle tends to increase when a shelf edge is lowered over the upper body portion towards the shelf flange.

8. The shelf support of claim 7, wherein an upper part of the upper body portion connects with a lower part of the upper body portion at a resilient junction so as to together form an obtuse angle on the back face of the body member, and wherein the upper body portion deflects in the direction of the back face of the body member when a shelf edge is lowered over the upper body portion towards the shelf flange.

9. The shelf support of claim 8, wherein the finger is connected to the upper body portion adjacent the top of the opening at a resilient junction.

10. The shelf support of claim 2, wherein the shelf support further comprises a reinforcing gusset connected between the lower body portion and the underside of the stem holder.

11. A shelf support for locking an edge of a shelf in place adjacent a side wall, the shelf support comprising:

a body member having a lower body portion and a middle body portion that meet at a first resilient junction, and an upper body portion that meets the middle body portion at a second resilient junction, wherein the lower body portion and the middle body portion together form a first obtuse angle on a front face of the body member, wherein the middle body portion and the upper body portion together form a second obtuse angle on a back face of the body member, wherein the body member includes an aperture in its lower body portion, and wherein the upper body portion includes an inner opening formed therein;

a downwardly extending finger that connects to the upper body portion at a third resilient junction adjacent the top of the opening, wherein the finger is dimensioned to be collapsibly received within the opening;

a shelf flange extending from the front face of the lower body portion of the body member;

a stem holder having a cavity formed therein, wherein the stem holder extends from the front face of the lower body portion of the body member, and wherein a top surface of the stem holder engages a lower surface of the shelf flange such that the stem holder acts to reinforce the shelf flange; and a metal stem having first and second ends, wherein the first end of the stem is disposed within the cavity in the stem holder, wherein the second end of the stem extends from the back face of the lower body portion of the body member and wherein the stem passes through the aperture in the lower body portion of the body member.

12. The shelf support of claim 11, wherein the body member, the finger, the shelf flange and the stem holder are formed from a polymer material.

13. The shelf support of claim 12, wherein the body member, the shelf flange and the stem holder are formed by injection molding.

14. The shelf support of claim 13, wherein the stem has a non-uniform cross section.

15. The shelf support of claim 11, wherein the shelf support further comprises a reinforcing gusset connected between the lower body portion and the underside of the stem holder.

16. A shelf support, comprising:

a substantially straight body member having a front face and a back face, wherein the body member includes a lower body portion and an upper body portion, and wherein the upper body portion includes an inner opening formed entirely therein, the back face of the body member adapted to abut and overlie an adjacent wall;

a shelf flange extending from the front face of the lower body portion of the body member;

a finger extending downwardly from adjacent the top of the opening towards the shelf flange, wherein the finger is dimensioned to be collapsibly received within the inner opening;

a stem holder having a cavity formed therein extending from at least one of the front face or the back face of the body member, the stem holder extending from the back face of the body member; and a metal stem that is received at least partly within the cavity in the stem holder, wherein at least a portion of the stem extends from the back face of the body member;

wherein the stem holder encases substantially the entire stem.

17. The shelf support of claim 16, wherein the stem has a non-uniform cross section.

18. The shelf support of claim 16, wherein the body member includes an aperture adjacent the stem holder, and wherein a portion of the stem passes through the aperture into the cavity in the stem holder.

19. The shelf support of claim 16, wherein the stem holder extends from the front face of the lower body portion of the body member, and wherein a top surface of the stem holder engages a lower surface of the shelf flange such that the stem holder acts to reinforce the shelf flange.

20. The shelf support of claim 16, wherein the body member, the shelf flange and the stem holder are formed from a polymer material.

21. The shelf support of claim 20, wherein the shelf support is formed using an injection molding process, wherein the cavity in the stem holder is created by injection molding the stem holder so as to at least partly encase the metal stem.

22. The shelf support of claim 17, wherein the shelf support further comprises a reinforcing gusset connected between the lower body portion and the underside of the stem holder.

* * * * *